United States Patent [19]

Wisowaty

[11] 4,174,793

[45] Nov. 20, 1979

[54] STORAGE RECEPTACLE

[76] Inventor: Sigmund Wisowaty, P.O. Box 601, Medinah, Ill. 60157

[21] Appl. No.: 921,486

[22] Filed: Jul. 3, 1978

[51] Int. Cl.[2] ..... A45C 1/04

[52] U.S. Cl. ..... 224/240; 224/253

[58] Field of Search ..... 224/5 R, 5 C, 21, 22, 224/26 R, 26 C, 28 E, 5 L, 26 D, 28 B; 150/40; 2/312, 313

[56] References Cited

U.S. PATENT DOCUMENTS

| | | | |
|---|---|---|---|
| 1,966,019 | 7/1934 | Mishey | 224/5 R |
| 3,147,896 | 9/1964 | Kehl | 224/26 R |
| 3,286,751 | 11/1966 | Dishart | 224/26 R |
| 3,295,235 | 1/1967 | Tauber | 224/5 R |
| 3,664,560 | 5/1972 | Perkins | 224/5 R |
| 4,047,650 | 9/1977 | Domingos | 224/21 |

FOREIGN PATENT DOCUMENTS

| | | | |
|---|---|---|---|
| 68573 | 6/1914 | Switzerland | 224/26 C |

*Primary Examiner*—Robert J. Spar
*Assistant Examiner*—Kenneth W. Noland
*Attorney, Agent, or Firm*—Jakala, Knechtel, Valentino, Demeur and Dallas

[57] ABSTRACT

A storage receptacle is formed by a length of material having opposed terminal ends and a substantially centrally positioned fold line, the length of material being foldable along the central fold line to create two substantially equal sections, each of the sections including one or more storage compartments formed therein. Each of the storage compartments is ideally provided with a closure flap, and fastening elements are interposed between the closure flap and the storage compartment thereby to permit the sealing of each of the storage compartments. Finally, other fastening elements are further provided in connection with the terminal ends of the length of material to permit the sections to be folded over and fastened together such that the entire receptacle may be stored about a support such as a belt.

1 Claim, 6 Drawing Figures

FIG. 1
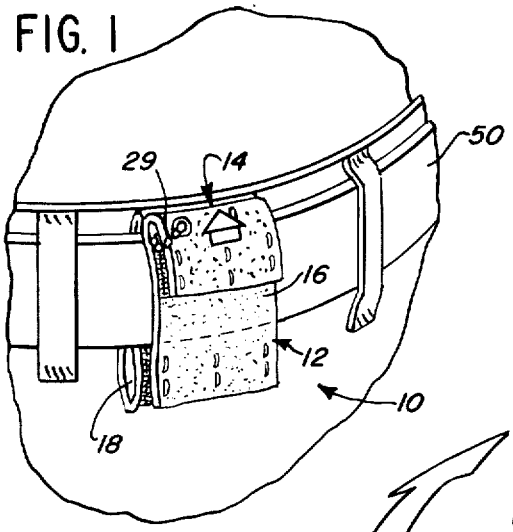
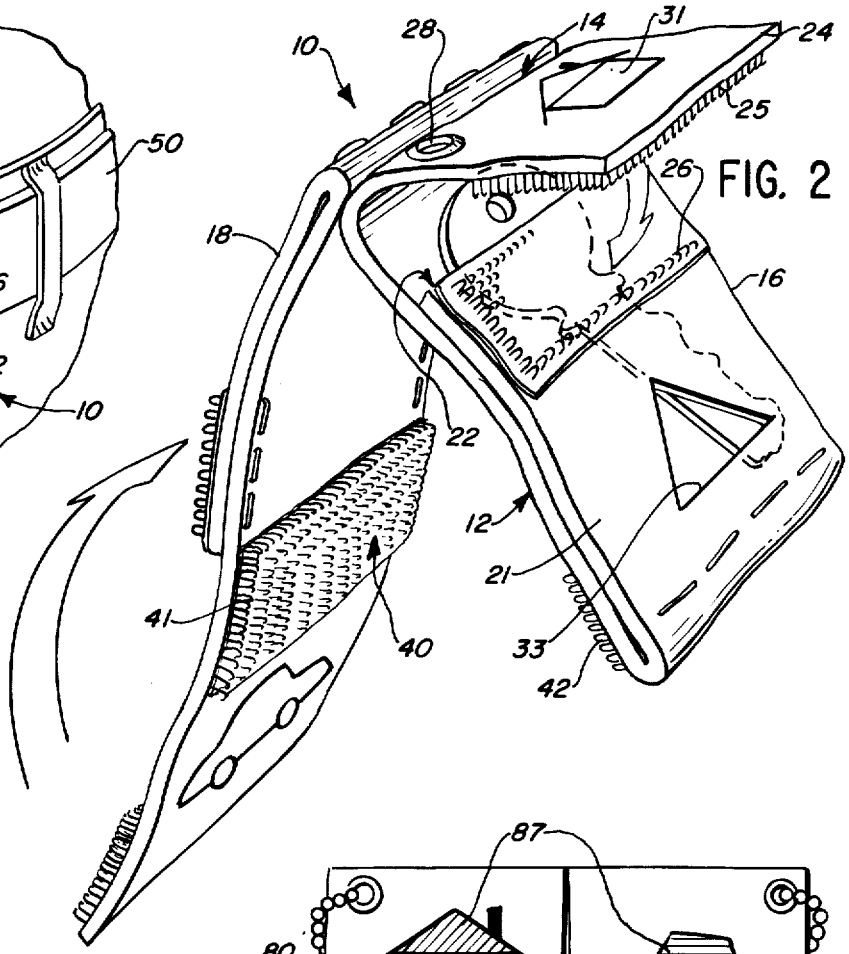
FIG. 2
FIG. 3
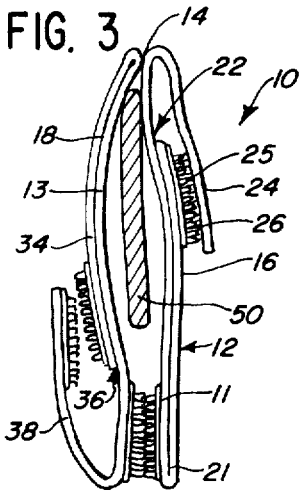
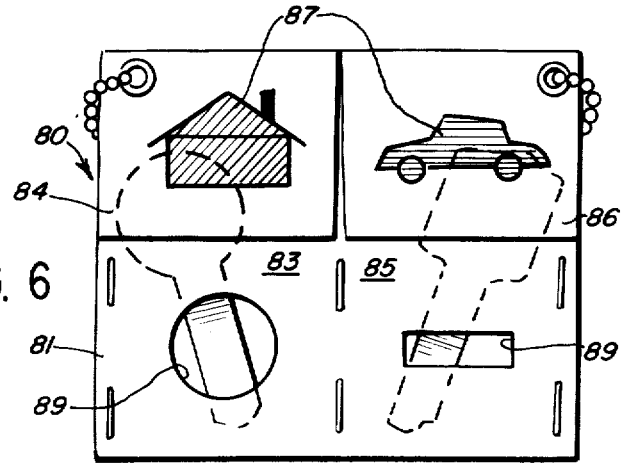
FIG. 6
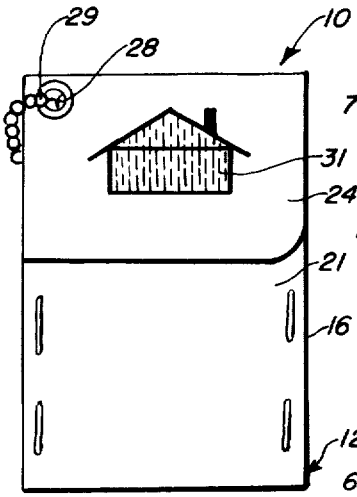
FIG. 4
FIG. 5
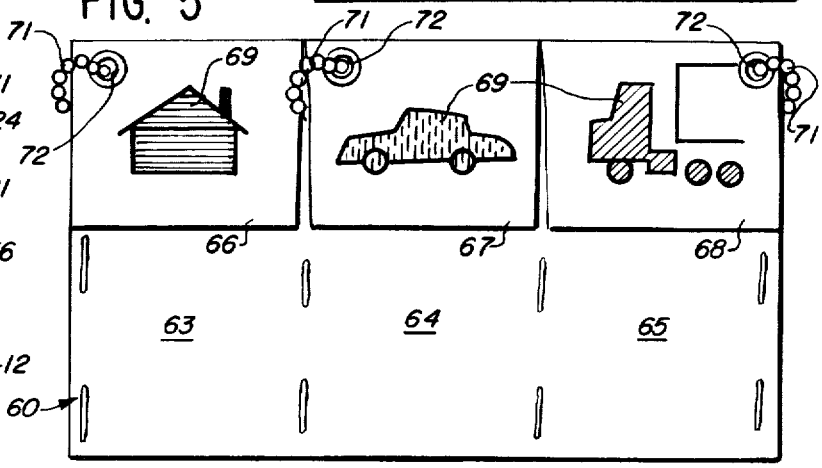

STORAGE RECEPTACLE

BACKGROUND OF THE INVENTION

Many different types and forms of key cases have been developed and have been commercialized with a view toward either simplifying the storage of small contents such as keys or the like, or compacting the same into the smallest possible case for the convenience of the user. The purpose of the present invention is to provide a simplified yet more efficient storage receptacle for use with the storage of items, particularly keys, which permits a great deal of flexibility of use by the ultimate user.

The basis of the present invention is to permit the user to utilize the storage receptacle especially in connection with keys, and to permit the user to carry the same either in a pocket, or to fasten the case about a support such as a belt, purse strap, or other similar support, without interfering with the utilitarian aspect of the case. In addition, the storage receptacle is provided with, in the preferred embodiment, a plurality of storage compartments thereby to accommodate the storage of a plurality of contents such as an assortment of keys.

With regard to other attempts at achieving the same type of storage and segregation of a plurality of contents such as keys, various prior art attempts have been made at a similar arrangement. For example, in U.S. Pat. No. 2,884,037, there is disclosed a carrying case for keys wherein separate keys are carried in distinctly separated storage compartments. It will be noted that each of the keys is pivotally mounted on a pin such that each of the separate keys may be removed to an in use position and pivoted down to a storage position in a segregated compartment. It will be apparent, however, that the carrying case disclosed in U.S. Pat. No. 2,884,037 can only be carried in a pocket or a purse, and does not appear to provide a means to carry the storage receptacle about a support such as a purse strap or belt. In addition, no indicia are provided such that the user can quickly identify the particular key needed for a given function, and hence, the ultimate user would either have to commit to memory the location of the key, or simply use a trial and error method to find a proper key for use in a given lock.

Similar comments are applicable with respect to U.S. Pat. No. 2,915,099 which shows a storage key receptacle wherein the keys are inserted in slots within the receptacle. In this connection, it will be noted that each of the slots is provided with visually identifiable indicia means such that the ultimate user can segregate the keys and identify a relevant key by reading the imprinted notation. It will further be observed that the storage receptacle shown in U.S. Pat. No. 2,915,099 further includes a central fold line and a flap which folds over the rack of keys in the nature of a closure flap. However, no fastening means are illustrated which would insure that the keys cannot be accidentally removed from the storage case, and further and even more importantly, the closure flap depicted in U.S. Pat. No. 2,915,099 cannot be fastened with respect to the key carrying portion of the receptacle.

A similar form of key carrying case is shown in U.S. Pat. No. 3,563,293 wherein the case is shown to include two sections of substantially equal dimensions foldable about a central fold line. In this case, the two sections are provided with magnetic strips thereby functioning as fastening means for fastening the two sections together. It will be appreciated, however, that a case of the type shown in U.S. Pat. No. 3,563,293 is generally not intended to be carried about any support such as a strap or belt, and indeed, the thickness of the strap would prevent the magnetic strips from fastening. In addition, no indicia are shown in conjunction with the location of the keys, and hence, the ultimate user is again faced with the problem of locating a particular key for a particular lock. Finally, no discrete storage compartments are illustrated, but rather, the keys are simply carried in an elongate compartment and the keys must then be manipulated in order to be removed and utilized.

Finally, U.S. Pat. No. 3,926,234 illustrates still another form of a container for storing keys wherein discrete storage compartments are provided for each separate key, and some key identification means is employed in conjunction with each compartment. It will be noted that the overall receptacle is foldable into three sections and it is fairly apparent that the entire case is intended to be carried on the person of the user. However, no fastening means is provided for fastening the sections together in the manner of the present invention, and indeed, the case shown in U.S. Pat. No. 3,926,234 is not easily usable in connection with fastening about a support such as a strap or belt.

It will be appreciated that the present invention is therefore intended to function as an improvement with respect to a storage receptacle, especially adapted for carrying keys, although the storage receptacle of the present invention clearly has usage beyond simply the carrying of keys.

OBJECTS AND ADVANTAGES

It will therefore be appreciated that the principal object of the present invention is to provide an improved storage receptacle for use in connection with a plurality of items to be contained which is formed from a length of material intended to be folded about a substantially centrally positioned fold line, and further provided with fastening means along the terminal ends of the length of material such that the sections may be folded about a support and retained in position.

In conjunction with the foregoing object, it is yet a further object to provide a storage receptacle wherein each of the substantially equal sections of the case are provided with at least one storage compartment to contain the designated contents in their own discrete compartments.

In further conjunction with the foregoing object, it is yet another object of the invention to provide an improved storage receptacle wherein each of the substantially equal sections of the receptacle are provided with a plurality of compartments thereby to contain a plurality of discrete items, and wherein each of the discrete storage compartments is provided with indicia means to clearly indicate to the user the specific contents of the storage compartment, while still permitting the sections of the receptacle to be fastened about a support such as a belt or strap.

In conjunction with the foregoing objects, it is still a further object of the invention to provide an improved storage receptacle wherein the fastening means is formed by Velcro type fasteners of the type providing a series of loops and hooks as a fastening system such that the two sections of the receptacle may be fastened about the support in disengageable fastening arrangement, and each of the compartments is provided with a closure flap, similarly provided with Velcro type fasteners thereby permitting each of the storage compartments to be separately enclosed.

In further conjunction with the objects as set forth above, another object of the invention is to provide a storage receptacle of the type described wherein the indicia means may be in the form of either color coded indicia, visually ascertainable figures as the indicia, or indicia which are positioned out of the plane of the length of material forming the receptacle such that the indicia are detectable to the touching contact of the user.

Further features of the invention pertain to the particular arrangements of the parts whereby the above outlined objects and advantages may be attained. The invention both as to its organization and method of operation will best be understood by reference to the accompanying drawings as described hereinbelow.

DESCRIPTION OF THE DRAWINGS

With respect to the drawings, the following are illustrated:

FIG. 1 is a plan view showing one embodiment of the storage receptacle of the present invention as fastened about a support such as a belt worn by the ultimate user;

FIG. 2 is a perspective view showing the embodiment of the storage receptacle utilized as a key case of the type depicted in FIG. 1, fully unfastened and wherein each of the two sections is provided with a single storage compartment, an enclosure flap for separately enclosing each of the storage compartments, and separate fastening means to achieve the fastening about a support such as a belt or a strap;

FIG. 3 is a side elevational view showing the method of construction of the receptacle as shown in FIG. 2 of the drawings and illustrating the various fastening means employed with respect to each of the pouches as well as the receptacle itself;

FIG. 4 is a front elevational view showing one embodiment of the storage receptacle of the present invention wherein there is provided a series of two compartments, one in connection with each of the sections of the storage receptacle;

FIG. 5 is another form of the receptacle of the present invention wherein each of the sections is provided with three distinct compartments for the storage of contents such as keys, yielding a total of six compartments with respect to both of the equal sections; and FIG. 6 illustrates still another embodiment of the storage receptacle of the present invention wherein each of the sections of the storage receptacle are provided with two distinct storage compartments yielding an overall of four storage compartments in conjunction with the subject storage receptacle and further illustrating two of the indicia means of the present invention.

SUMMARY OF THE INVENTION

In summary, the invention provides an improved storage receptacle especially adapted for the storage of articles such as keys, wherein the storage receptacle is provided with a plurality of distinct and separated storage compartments such that the articles to be stored may be segregated for organizational purposes. The storage receptacle is formed by a length of material which includes a substantially centrally positioned fold line about which a length of material may be folded into two equal sections. Each of the sections includes at least one, or a plurality of distinct compartments, and further including a closure flap thereby to close off the corresponding compartment. The terminal ends of the length of material are provided with disengageable fastening means such that the two sections may be folded around a support such as a strap or belt, and secured in position by securing the fastening means. In addition, each of the closure flaps are similarly provided with fastening means interposed between the flap and the compartment such that the compartments may be sealed off to retain the contents therein. In the preferred embodiment, each of the sections contain a plurality of distinct compartments such that a plurality of articles may be separately retained in the storage compartments for organizational purposes.

In addition, the invention provides a plurality of storage compartments which may include separate indicia means which can function visually, or by touching contact in order to permit the user to quickly and easily distinguish the contents of each corresponding compartment. In this connection, the indicia means may be by pictorial representation, color coding, or three dimensional out-of-the-plane indicia such that the indicia are recognizable to the sense of touch. In this connection, the subject storage receptacle of the present invention may be employed by sightless users while still permitting the indicia means to function in a manner which permits the user to distinguish between the contents of differing ones of the compartments.

Finally, the storage receptacle of the present invention may additionally be provided with an aperture which accommodates the insertion of a chain therethrough, such that the contents of the storage compartment may be chained to the receptacle to insure that the contents do not become remotely removed from the vicinity of the storage compartment.

DETAILED DESCRIPTION OF THE DRAWINGS

With reference to FIGS. 1–3 of the drawings, a representative embodiment of the storage receptacle, generally referred to by the numeral 10, is illustrated. As shown therein, the storage receptacle 10 is formed by a length of material 12 which may be natural material such as leather, or the like, or synthetic material such as plastic. The length of material 12 is shown to include a substantially centrally positioned fold line 14 about which the length of material 12 is folded. In the folded posture, the length of material 12 forms two substantially equal sections denoted by the numerals 16 and 18.

As particularly shown in FIGS. 2 and 3, the length of material 12 may actually be formed of two separate pieces of material, denoted by the numerals 11 and 13 in FIG. 3. In this form, the two separate lengths of material 11 and 13 may be connected by means of stitching (not shown) which would in effect form the central fold line 14. However, once assembled, it is considered that the storage receptacle 10 is in effect formed of a single length of material 12 which, when folded around the center fold line 14, forms two sections, 16 and 18 as described above.

Constructionally it will be observed that section 16 includes a reverse fold generally denoted by the numeral 21 which is secured to the length of material 12 along the peripheral edges thereof to form a storage compartment generally indicated by the numeral 22. A closure flap 24 is provided which is designed to enclose the compartment 22 thereby to retain the articles contained in the storage compartment 22 securely therein. It will further be noted that interposed between the storage compartment 22 and closure flap 24 are fastening means which in the present embodiment are shown to be of the Velcro fastener type. Hence, it will be observed that the closure flap 24 is provided with a plurality of hooks 25 while the upper portion of the storage compartment 22 is provided with a plurality of loops 26 such that when the hooks 25 are pressed against the loops 26, fastening of the two pieces is achieved.

As will further be observed in FIG. 2, the closure flap 24 may be provided with an aperture 28 which accommodates the insertion of a retention means such as a length of chain 29 (FIG. 1) which functions to restrain and arrest the contained article such as a key, with respect to the corresponding storage compartment 22. Hence, additional security is provided such that the articles to be stored in the storage compartment 22 even when used by the user, cannot be separated from the storage receptacle 10.

It will further be noted from FIG. 2 that the storage compartment 22 may further be provided with various indicia means. For example, on the closure flap 24, visually discernable indicia are disclosed, the indicia being the pictorial representation of a house, denoted by the numeral 31. In this manner, the user is immediately alerted to the fact that storage compartment 22 contains a key intended for a lock associated with the door to his home. Additionally, as shown on the reverse fold 21 of the length of material 12, a second form of indicia is provided. In this case, the cut-out triangular section denoted by the numeral 33 is provided, the cut-out indicia being formed by cutting into the material forming the reverse fold 21. It will therefore be appreciated that a sightless person may still employ the subject storage receptacle and utilize the indicia means by a sense of touch in order to distinguish the compartment 22 carrying the household keys. In this manner, the storage receptacle 10 achieves an even broader degree of usage and permits handicapped persons to utilize the same with the same degree of efficiency as a non-handicapped person.

Additionally, and as particularly illustrated in FIGS. 4–6 of the drawings, the pictorial indicia may further be color coded such that the indicia has immediately identification to the user regardless of any particular pictorial representation shown thereon. Hence, the present invention provides a storage receptacle 10 which may include any one or more of the various forms of indicia for quick identification of the contents of the storage compartment.

As shown in FIG. 3, the second section 18 of the storage receptacle 10 is formed in a manner similar to the description with respect to storage compartment 22. The length of material 12 is provided with an additional reverse fold section 34, which is secured to the length of material 12 about the peripheral side ends. In this manner, the second storage compartment 36 is formed. A second storage compartment 36 is similarly provided with a closure flap 38 which again is fastened to the compartment 36 by means of a Velcro type fastener in the method heretofore described. Hence, in the embodiment as illustrated in FIGS. 1–3 of the drawings, the storage receptacle 10 is provided with two storage compartments 22 and 36 respectively, and will function to permit the user to segregate at least two different articles such as two different sets of house keys and car keys and the like.

It will further be illustrated from FIGS. 1 and 3 of the drawings that the two sections 16 and 18 respectively are also provided with fastening means formed by a Velcro type fastener generally denoted by the numeral 40. Again, the Velcro type fastener consists of a plurality of loops 41 which are fixedly mounted to one of the sections 18, and a plurality of hooks 42, which when pressed together with the loops 41 will disengageably fasten. It is apparent from FIGS. 1 and 2 of the drawings, that the two sections 16 and 18 respectively can be folded over and about a support such as a belt 50, thereby to retain the entire storage receptacle 10 in engaged relationship with respect to the support 50. In this manner, the storage receptacle 10 can be worn by the ultimate user on his person, without the requirement that the receptacle 10 be stored in a pocket, or a purse, or otherwise encumber the clothing of the user.

As will be observed from FIGS. 5 and 6 of the drawings, a modified form of a storage receptacle 60 is depicted therein. With specific reference to FIG. 5, the storage receptacle 60 depicted therein is constructed in the same manner as indicated with respect to the receptacle 10 shown in FIG. 2. In other words, the receptacle 60 is formed by a first section 62, and a second section which is positioned to the rear of the first section 62 and not illustrated in FIG. 5. The first section 62 is shown to be formed by a plurality of three compartments 63, 64 and 65 respectively. Each compartment is similarly provided with a closure flap 66, 67 and 68 respectively and each of the closure flaps 66, 67 and 68 being provided with visual indicia each denoted by the numeral 69. As further noted in FIG. 5, the visual indicia may be color coded, or indeed, while not shown in the drawings, the visual indicia 69 need not even take on any pictorial representation, but simply may be color coded shapes.

Again as will be observed in FIG. 5, each of the articles, in this case keys, contained within each separate storage compartment may be provided with a length of chain 71 which passes through corresponding aperture 72. As was shown in FIG. 2 of the drawings, the length of chain 71 passes through the article retained in the corresponding storage compartment such as a key, and then through the aperture 72 so that even when the key is removed from the storage compartment, it cannot be separated from the storage receptacle 60.

It will be appreciated from the description of FIG. 5, especially taken in connection with the teachings of FIG. 2 of the drawings, that a total of six storage compartments is provided in connection with the storage receptacle 60 shown in FIG. 5.

With respect to FIG. 6 of the drawings, a storage receptacle 80 shown therein is, once again, formed in the same manner as the storage receptacle 10 described in FIGS. 2 and 3 of the drawings, but in this embodiment, only four compartments are provided. The first section 81 of the receptacle 80 is shown to be provided with two compartments 83 and 85 respectively, while the reverse section (not shown) is similarly provided with two compartments in the manner heretofore described. Again, compartment 83 is provided with a closure flap 84, while the second compartment 85 is similarly provided with a closure flap 86. Once again, it will be observed that a variety of indicia may be utilized, and as shown in FIG. 6, both visual and three dimensional type indicia are employed. The visual indicia 87 may be both pictorial as well as color coded as indicated, and in addition to these indicia, three dimensional indicia 89 may also be employed. The three dimensional indicia 89 may be formed by simply cutting into the material forming the first section 81 such that the indicia is actually formed by being out of plane with surface of the section 81. It will also be observed that where formed cut-out indicia 89 are utilized, one should employ curved or rounded indicia in the compartment adjoining a compartment where rectangular or other squared off three dimensional indicia are employed. In this manner, a sightless person can more readily distinguish between a circle and a rectangle, for example, than between a rectangle and a triangle.

It will be appreciated from the above description that the storage receptacle provided by the present invention may be constructed in the manner to provide a plurality of compartments, indeed, in excess of three compartments per section, as well as single unitized compartments as illustrated with respect to FIGS. 1–4 of the drawings. It will also be appreciated that while the fastening means illustrated in connection with the present invention indicate Velcro type fasteners being utilized, nevertheless, snap fasteners or other similar fastening means may be employed without departing from the spirit or scope of the invention.

As was also indicated previously, the storage receptacle of the present invention could be formed from a single length of material which includes reverse folded sections to conform the compartments in the storage flaps, or the same may be constructed by the use of two distinct lengths of material which are interconnected by stitching or other bonding means. The important functional advantage to be achieved is that the two sections of the receptacle can be folded about a centerfold line so that the same will be supported by a support such as a belt or strap, and thereby permit the user to retain the receptacle without at the same time having to place a bulky receptacle in a pocket or purse. In addition, it is deemed desirable to form a receptacle which has indicia means positioned thereon which may be employed by handicapped as well as non-handicapped users, and the present invention provides both types of indicia.

From the above description, it will be appreciated that the present invention has provided an improved and simplified storage receptacle for use with various articles such as keys or the like, which is nevertheless constructed to permit ease of organization of the various articles to be stored. It will therefore be appreciated that all of the above objects and advantages have been fulfilled by the present invention, as well as additional objects and advantages not herein set forth.

While there has been described what is at present considered to be the preferred embodiments of the invention, it will be understood that various modifications may be made therein and it is intended to cover in the appended claims all such modifications as fall within the true spirit and scope of the invention.

What is claimed is:

1. A storage receptacle provided with a plurality of storage compartments, comprising, a length of material having opposed ends and a substantially centrally positioned fold line, said fold line permitting said length of material to be folded about said fold line thereby to create substantially equal sections about said fold line, each of said substantially equal sections including at least one discrete storage compartment, each of said storage compartments provided with a closure flap, fastening means interposed between each of said closure flaps and each of said corresponding storage compartments such that each of said closure flaps may be disengageably fastened to enclose each of said corresponding storage compartments, and disengageable fastening means associated with said ends of said length of material thereby to permit said equal sections to be disengageably fastened at said ends thereof, whereby said storage receptacle may be folded over by folding said length of material along said fold line thereby to permit said equal sections to encircle a support such as a belt, and fastening the storage receptacle in position by said disengageable fastening means whereby such storage receptacle including each of said storage compartments may be securely held in position about the support.

* * * * *